United States Patent [19]

Hope et al.

[11] 4,014,536

[45] Mar. 29, 1977

[54] FEEDING APPARATUS FOR X-RAY FILM AND THE LIKE

[76] Inventors: Henry F. Hope; Stephen F. Hope, both of 2421 Wyandotte Road, Willow Grove, Pa. 19090

[22] Filed: Aug. 18, 1976

[21] Appl. No.: 715,623

[52] U.S. Cl. ..... 271/162; 271/8 R; 250/468

[51] Int. Cl.[2] ..... B65H 1/00

[58] Field of Search ..... 271/8 R, 8 A, 18, 162; 250/468

[56] References Cited

UNITED STATES PATENTS

| | | | |
|---|---|---|---|
| 3,364,835 | 1/1968 | Brackett et al. | 250/468 |
| 3,720,408 | 3/1973 | Horn | 271/18 R |
| 3,964,107 | 6/1976 | Stievenart et al. | 350/468 |

FOREIGN PATENTS OR APPLICATIONS

| | | | |
|---|---|---|---|
| 1,966,526 | 1/1973 | Germany | 271/162 |

*Primary Examiner*—Robert W. Saifer
*Attorney, Agent, or Firm*—Zachary T. Wobensmith, 2nd; Zachary T. Wobensmith, III

[57] ABSTRACT

Apparatus for feeding small and large X-ray film and the like to processing machines is disclosed which includes an entrance section contiguous to infeed rolls of the processing machine, which can receive the film, and which has a movable closure and a chute movable into a feeding position with respect to the entrance section when the closure is in an open position, the chute having a closure and being of a length to accommodate the large film as it is advanced by the infeed rolls.

6 Claims, 5 Drawing Figures

FEEDING APPARATUS FOR X-RAY FILM AND THE LIKE

BACKGROUND OF THE INVENTION

1. Field of the Invention

This invention relates to feeding apparatus for X-ray film and more particularly to such apparatus for handling film of various sizes.

2. Description of the Prior Art

Processing apparatus for X-ray and other film is now in use but problems arise in connection with feeding the film into the processing apparatus.

In the U.S. patents to Henry Hope, U.S. Pat. Nos. 3,312,462 and 3,409,292 automatic film receiving and feeding machines are shown which include a casing fixed to the processing apparatus having hinged light excluding doors and an interior reciprocatory carriage and pusher which are advanced to supply either large film or small films from a stack to feed rolls for introduction between continuously rotating film receiving and advancing nip rolls in the processing apparatus. Limit switches are provided to control the film advance and delivery.

In our prior U.S. Pat. No. 3,712,205 a daylight film loader is shown for attachment to automatic film developing equipment which includes a rotatably mounted dome having access openings to the interior for the arms and hands of the operator.

The structures heretofore available were not too well suited for feeding into the film processing apparatus both relatively large film and small films because of the complexity of the apparatus employed.

SUMMARY OF THE INVENTION

In accordance with the invention feeding apparatus for film of different sizes is provided for use with film processing equipment which includes an entrance section with a hinged cover and particularly suited for insertion and gravity feeding of a plurality of small films along a horizontally elongated slot which is capable of receiving larger film and an auxiliary chute for receiving and delivering larger film, the auxiliary chute upon opening of the hinged cover being movable into a position in engagement with the entrance section.

It is the principal object of the invention to provide feeding apparatus for X-ray film and the like to be processed where the film is of different sizes, which is simple in construction, effective in its action, and which does not require any power input for actuation.

It is a further object of the invention to provide feeding apparatus for X-ray film and the like which furnishes adequate protection to the film as it is fed into the film processing equipment.

It is further object of the invention to provide feeding apparatus for X-ray film and the like which is easy to operate.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 2:
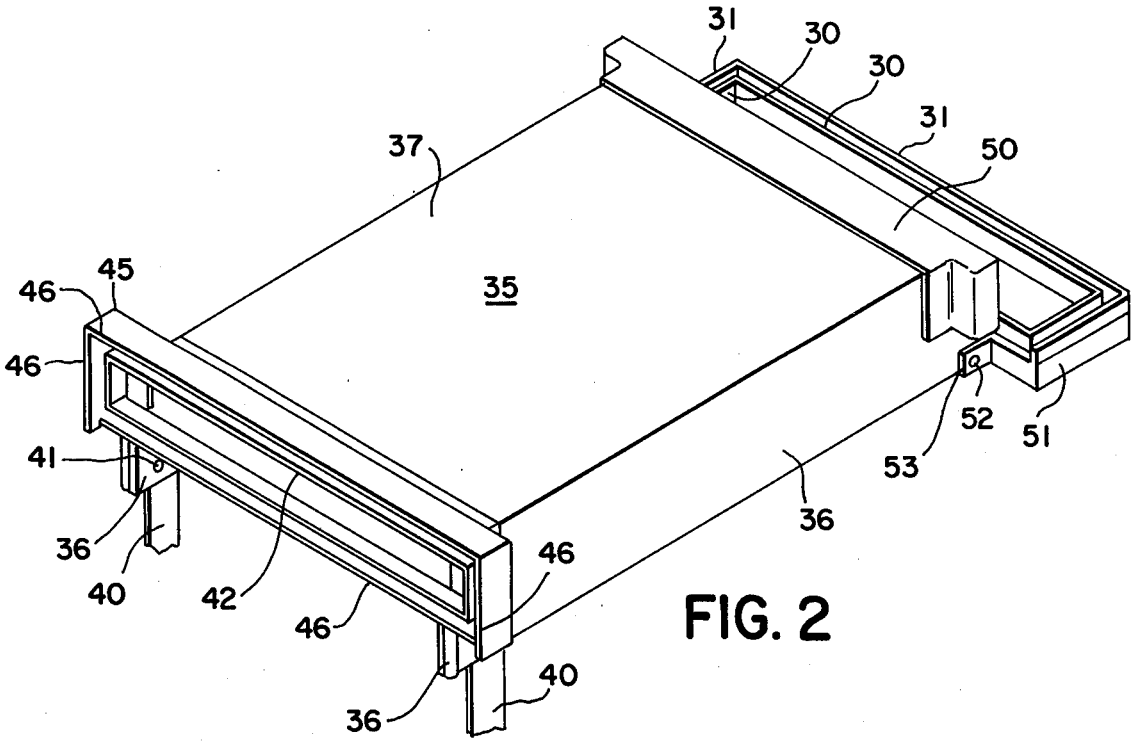
FIG. 2 is a view in perspective showing another position of the chute.
Figure 1:
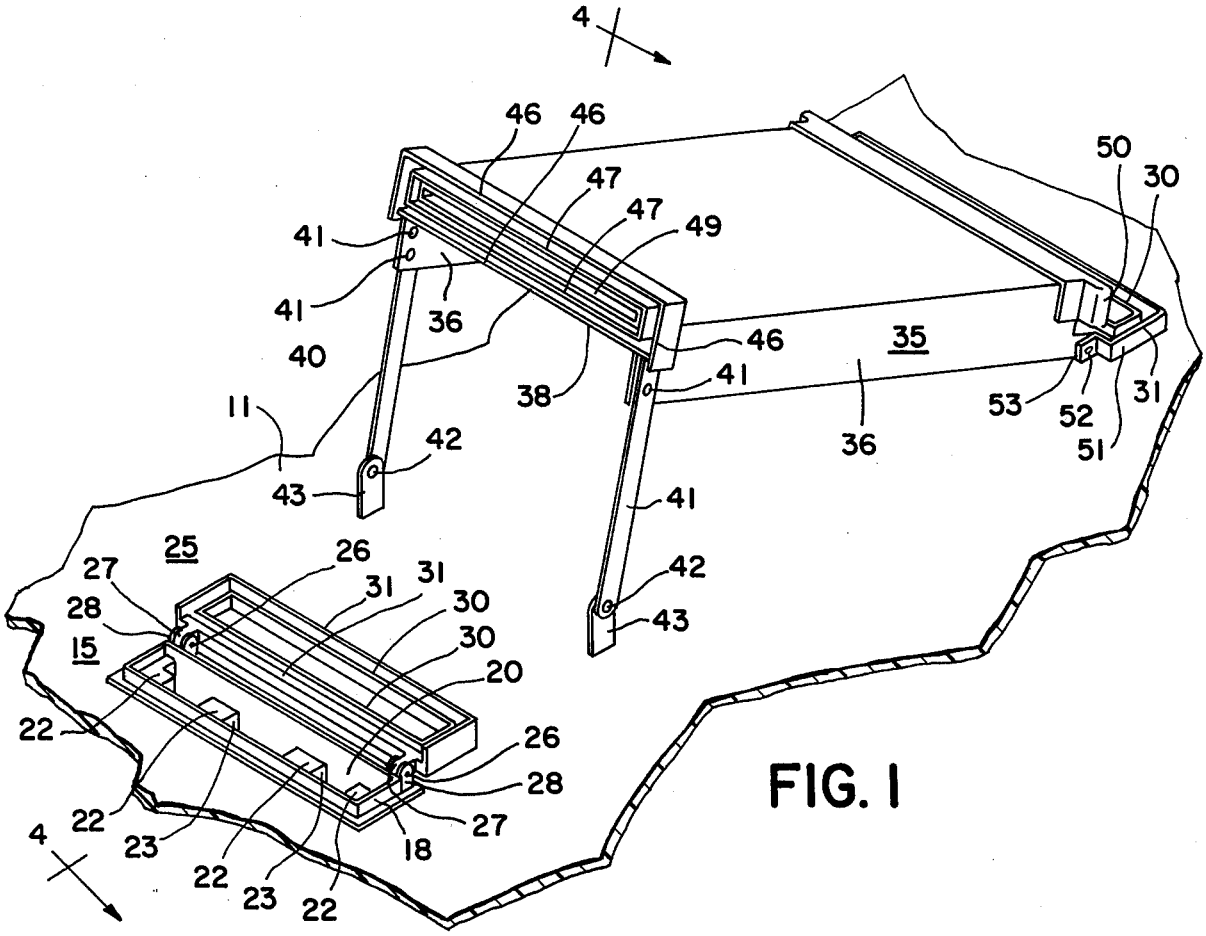
FIG. 1 is a view in perspective of the film feeding apparatus of the present invention with the cover plate for the entrance section in open position and with the chute in an inactive position.
Figure 4:
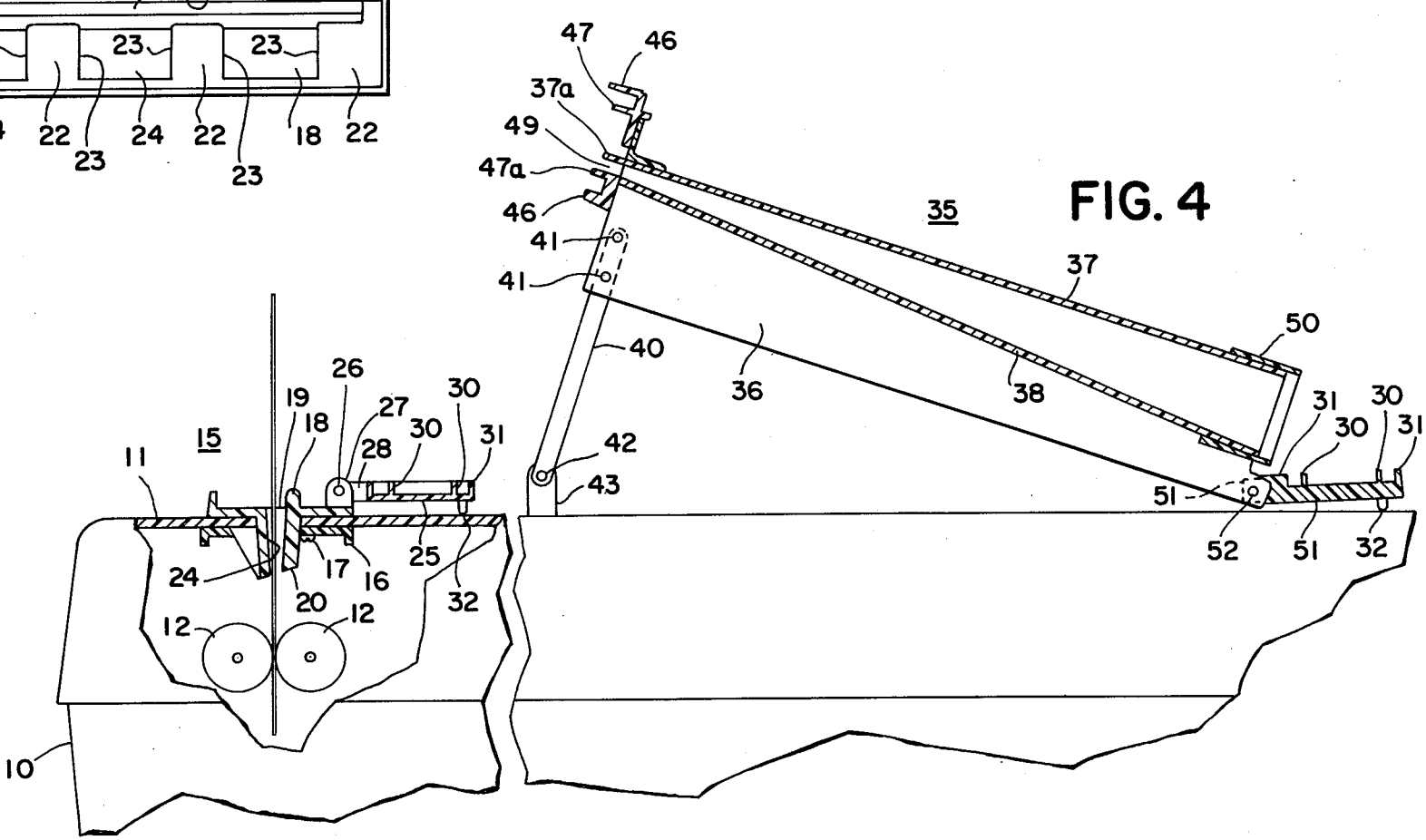
FIG. 4 is a fragmentary view, partly in elevational and partly in section taken approximately on the line 4—4 of FIG. 1 showing the chute in an inactive position.
Figure 3:
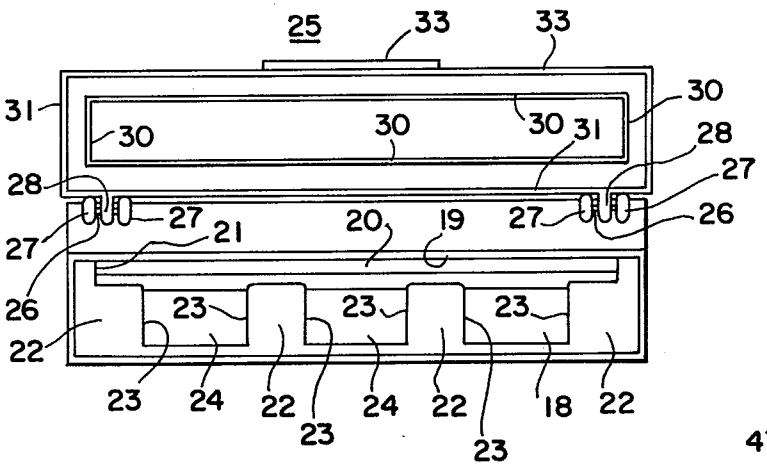
FIG. 3 is a top plan view of the entrance section.

It should, of course be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings a fragmentary portion of a film processing machine 10 is shown having a top cover 11 on which the apparatus of the present invention is preferably mounted for delivery of film to be processed to continuously rotating nip rolls 12 which draw the film F to be processed into the machine.

An entrance section 15 is provided preferably carried by the top cover 11 and preferably held in place by a clamping plate 16 disposed within the top cover 11 and screws 17 which extend through the clamping plate 16, the top cover 11 and engage in an exterior portion of the entrance section 15.

The entrance section 15 has an upwardly extending rim 18 in surrounding relation to a throat 19 which extends downwardly through an opening in the top cover 11.

The throat 19 has a longitudinally extending inclined guide wall 20 of a horizontal dimension to accommodate the large film to be fed and processed. The throat 19 has end wall portions 21 and in a specific embodiment these wall portions can be spaced slightly in excess of six inches for receiving film of that width. Along the throat 19, opposite to the wall 20, partitions 22 are provided with side boundary walls 23 extending downwardly therefrom, and connected by inclined guide walls 24. The horizontal distance between the side boundary walls 23 is sufficient to accommodate small films to be processed. The side walls 23 have inclined walls 24 therebetween in converging relation to but separated from the lower margin of the wall 20.

A closure 25 is provided, hingedly connected to the entrance section 15 by hinge pins 26 engaged with hinge lugs 27 on the entrance section 15 and hinge lugs 28 on the cover 25.

The closure 25 has an inner rim 30 and an outer rim 31 for respective disposition inside and outside the rim 18 in a meshing arrangement when the closure 25 is in covering relation to the entrance section 15 to prevent undesired light leakage into the interior of the film processing apparatus.

The closure 25 also has an elongated rib 32 along the outer face thereof which serves as a support when the closure 25 is in the position shown in FIGS. 1, 3, 4 and 5. A short rib 33 on the closure 25 facilitates manual movement of the closure 25. The structure just described is suitable for the delivery of small films but the time required for large films to enter would require an excessive time period and consequent likelihood of undesired exposure even in a dark room.

The provisions for further and selective utilization of the entrance section 15 for large films include a chute 35. The chute 35 has spaced parallel side walls 36 connected by an outer wall 37 and by a wall 38 in converging relation to the wall 37.

The chute 35 can be mounted in any desired manner to permit movement into operating position with respect to the entrance section 15. One suitable mounting is by pivot arms 40 rigidly connected to the side walls 36 by rivets 41 and to the top cover 11 by pivot pins 42 engaged with lugs 43 secured to the top cover 11.

The chute 35 has a connecting closure 45 at one end for engagement with entrance section 15 and with an outer rim 46 extending therefrom for positoning in surrounding relation to the rim 18 of an inner rim 47, a portion of which at 47a may be a continuation of the wall 38. The inner rim 47 is preferably disposed inwardly of the rim 18 and in interior surrounding relation thereto.

The wall 37 preferably extends inwardly as at 37a and the inner end of the wall 38 forming part of the rim 47 have a throat portion 49 therebetween and preferably extend into or substantially into the throat 19 to guide the large film into the throat 19.

The outer end of the chute 35 has a rim 50 and a closure 51, similar to the closure 25 and inner and outer rims 30 and 31 for disposition in a meshing relation to prevent passage of light to the interior. The closure 51 is hinged to the side walls 36 by pivot pins 52 extending through lugs 53 on the closure 51.

The mode of use will now be pointed out.

If small films are to be processed they can be inserted at the wall portions 24 and the closure 25 moved to closed position. These films will move downwardly through the throat 20 for engagement by the nip rolls 12 and advanced for processing.

Figure 5:
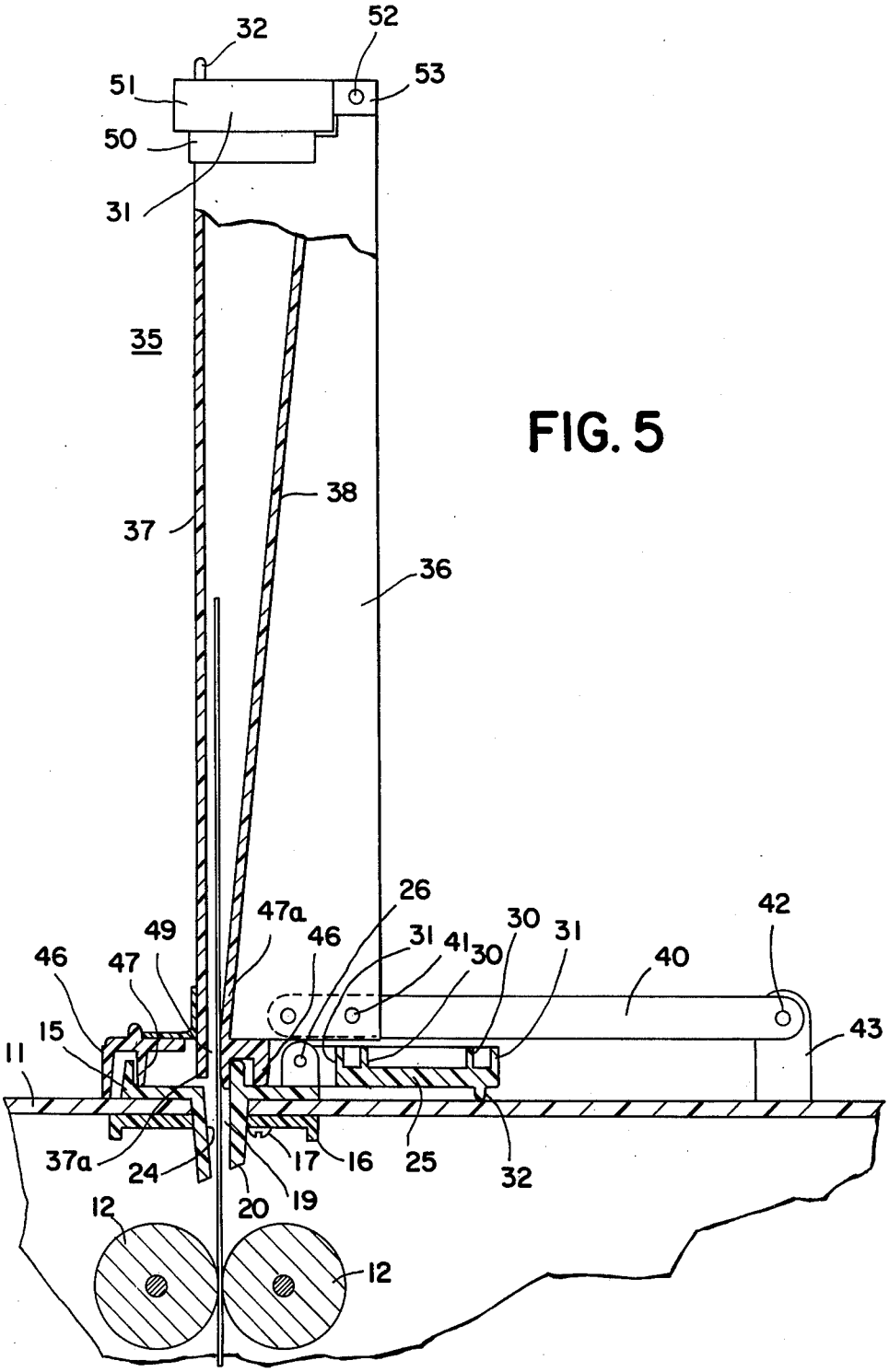
FIG. 5 is a view partly in elevation and partly in vertical section showing the chute in position for film feeding.

If it is desired to feed large film the closure 25 is swung to a horizontal position as shown in FIGS. 1, 3, 4 and 5 and the chute 35 swung to an upright position with its closure 45 in engagement with the entrance section 15 as shown in FIG. 5. The closure 51 is then moved to an open position, the film or the like inserted and the closure 51 returned to its closed position. The film is guided in the chute 35 by the space within the side walls 36 and the walls 37 and 38 through the throat 49 and the throat 19 for engagement and advance by the rolls 12.

The structure can be quickly and easily moved as required to accommodate the different sizes of films or the like.

The structure is preferably constructed of synthetic plastic material so that it is light in weight and inexpensive to manufacture. The material is preferably black in color or coated with a black finish to prevent light leakage at the entrance section, and at the closures 25, 45 and 51.

We claim:

1. Apparatus for feeding film or the like to a processing machine which comprises an entrance portion mounted on the top to the machine and communicating with the interior thereof, said entrance portion having a horizontally elongated throat with a downwardly extending wall along side thereof and of a width to receive a sheet of predetermined width, said throat along the opposite side thereof having a plurality of spaced downwardly extending wall portions of lesser width than the width of said throat for the reception of sheets of lesser width, said wall portions on opposite sides of said throat being in converging relation toward their lower margins, closure means movably mounted with respect to said entrance portion for selective disposition in a position in covering relation to said entrance portion or in a position permitting free access to said entrance portion, and auxiliary means for disposition for supplying material in sheet form to said throat, said auxiliary means comprising a plurality of enclosing walls providing a chute, said chute having an end portion for engagement with said entrance portion.

2. Apparatus for feeding film or the like as defined in claim 1 in which said entrance portion and said closure means have interengaging portions for preventing light leakage.

3. Apparatus for feeding film or the like as defined in claim 1 in which said entrance portion and said chute end portion have interengaging portions for preventing light leakage.

4. Apparatus for feeding film and the like as defined in claim 1 in which said auxiliary means has wall portions in converging relation to provide a throat, and said throat in an elevated position of said chute is aligned with the throat of said entrance portion.

5. Apparatus for feeding film and the like as defined in claim 1 in which said closure means is pivotally mounted on said entrance portion.

6. Apparatus for feeding film and the like as defined in claim 1 in which said auxiliary means is hingedly mounted on the top of said machine.

* * * * *

UNITED STATES PATENT OFFICE
CERTIFICATE OF CORRECTION

Patent No. 4,014,536 Dated March 29, 1977

Inventor(s) Henry F. Hope and Stephen F. Hope

It is certified that error appears in the above-identified patent and that said Letters Patent are hereby corrected as shown below:

Column 4,

Line 13, after "along" and before "side" insert - one -

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*